US007885810B1

(12) United States Patent
Wang

(10) Patent No.: US 7,885,810 B1
(45) Date of Patent: Feb. 8, 2011

(54) ACOUSTIC SIGNAL ENHANCEMENT METHOD AND APPARATUS

(75) Inventor: Chien-Chieh Wang, Hsinchu County (TW)

(73) Assignee: Mediatek Inc., Science-Based Industrial Park, Hsin-Chu (TW)

( * ) Notice: Subject to any disclaimer, the term of this patent is extended or adjusted under 35 U.S.C. 154(b) by 943 days.

(21) Appl. No.: 11/746,641

(22) Filed: May 10, 2007

(51) Int. Cl.
*G10L 19/14* (2006.01)

(52) U.S. Cl. ..... 704/225; 704/226; 704/233; 704/219; 704/228; 704/230

(58) Field of Classification Search ..... 704/225, 704/226, 233, 219, 205, 228, 230, 227, 210, 704/240, 201, 214, 203; 381/94.3, 94.2, 381/317

See application file for complete search history.

(56) References Cited

U.S. PATENT DOCUMENTS

| | | | | |
|---|---|---|---|---|
| 5,012,519 | A * | 4/1991 | Adlersberg et al. | 704/226 |
| 5,706,395 | A * | 1/1998 | Arslan et al. | 704/226 |
| 6,088,668 | A * | 7/2000 | Zack | 704/225 |
| 6,289,309 | B1 * | 9/2001 | deVries | 704/233 |
| 6,351,731 | B1 * | 2/2002 | Anderson et al. | 704/233 |
| 6,415,253 | B1 * | 7/2002 | Johnson | 704/210 |
| 6,542,864 | B2 * | 4/2003 | Cox et al. | 704/212 |
| 6,604,071 | B1 | 8/2003 | Cox | |
| 6,766,292 | B1 | 7/2004 | Chandran | |
| 6,778,954 | B1 * | 8/2004 | Kim et al. | 704/226 |
| 6,826,528 | B1 | 11/2004 | Wu | |
| 6,910,011 | B1 * | 6/2005 | Zakarauskas | 704/233 |
| 7,376,558 | B2 * | 5/2008 | Gemello et al. | 704/226 |
| 7,590,528 | B2 * | 9/2009 | Kato et al. | 704/226 |
| 2002/0002455 | A1 * | 1/2002 | Accardi et al. | 704/226 |
| 2002/0029141 | A1 * | 3/2002 | Cox et al. | 704/220 |
| 2002/0049583 | A1 * | 4/2002 | Bruhn et al. | 704/203 |
| 2003/0101055 | A1 * | 5/2003 | Son et al. | 704/240 |
| 2005/0222842 | A1 * | 10/2005 | Zakarauskas | 704/233 |
| 2006/0271362 | A1 * | 11/2006 | Katou et al. | 704/233 |
| 2007/0260454 | A1 * | 11/2007 | Gemello et al. | 704/226 |

OTHER PUBLICATIONS

Yariv Ephraim, et al., "Speech Enhancement Using a Minimum Mean-Square Error Short-Time Spectral Amplitude Estimator", IEEE Transactions on Acoustics, Speech, and Signal Processing, vol. ASSP-32, No. 6, Dec. 1984, pp. 1109-1121.

Patrick J. Wolfe, et al., "Efficient Alternatives to the Ephraim and Malah Suppression Rule for Audio Signal Enhancement", EURSAIP Journal on Applied Signal Processing, To appear. Special Issue: Audio for Multimedia Communications, Feb. 2003, pp. 1-15.

Israel Cohen, et al., "Noise Estimation by Minima Controlled Recursive Averaging for Robust Speech Enhancement", IEEE Sig. Proc. Let., vol. 9, Jan. 2002.

Dionysis E. Tsoukalas, et al., "Speech Enhancement Based on Audible Noise Suppression", IEEE Transactions on Speech and Audio Processing, Nov. 1997, vol. 5, No. 6, pp. 497-514.

* cited by examiner

*Primary Examiner*—Vijay B Chawan
(74) *Attorney, Agent, or Firm*—Winston Hsu; Scott Margo

(57) ABSTRACT

An acoustic signal enhancement method is disclosed. The acoustic signal enhancement method comprises the steps of applying a spectral transformation on a frame derived from an input acoustic signal to generate a spectral representation of the frame, estimating an a posteriori SNR and an a priori SNR of the frame, determining an a priori SNR limit for the frame, limiting the a priori SNR with the a priori SNR limit to generate a final a priori SNR for the frame, determining a spectral gain for the frame according to the a posteriori SNR and the final a priori SNR, and applying the spectral gain on the spectral representation of the frame so as to generate an enhanced spectral representation of the frame. One of the characteristics of the acoustic signal enhancement method is that the a priori SNR limit is a function of frequency.

39 Claims, 4 Drawing Sheets

ACOUSTIC SIGNAL ENHANCEMENT METHOD AND APPARATUS

BACKGROUND

The present invention relates to a method and apparatus for enhancing acoustic signals, and more particularly, to a method and apparatus that adaptively reducing noise that contaminates acoustic signals.

During recent years, applications of acoustic signal processing have been developing rapidly. These applications comprise hearing aids, speech encoding, speech recognition, etc. A major challenge encountered by the acoustic signal processing related applications is that they usually have to deal with acoustic signals that are already contaminated by background noise. This fact makes the performance of these applications be downgraded. To solve this problem, a great amount of work has been done in the field of noise suppression, and the following papers are incorporated herein by reference:

[1] Y. Ephraim and D. Malah, "Speech enhancement using a minimum mean-square error short-time spectral amplitude estimator," IEEE Transactions on Acoustics, Speech, and Signal Processing, vol. ASSP-32, no. 6, pp. 1109-1121, 1984.

[2] P. J. Wolfe and S. J. Godsill. "Efficient alternatives to the Ephraim and Malah suppression rule for audio signal enhancement." EURASIP journal on Applied Signal Processing, 2003. To appear. Special Issue: Audio for Multimedia Communications.

[3] I. Cohen and B. Berdugo, "Noise Estimation by Minima Controlled Recursive Aver-aging for Robust Speech Enhancement," IEEE Sig. Proc. Let., vol. 9, pp. 12-15, January 2002.

[4] D. E. Tsoukalas, J. N. Mourjopoulos, and G. Kokkinakis, "Speech enhancement based on audible noise suppression," IEEE Trans. Speech and Audio Processing, vol. 88, pp. 497-514, November 1997.

Many of the proposed noise suppression algorithms are based on the manipulation of the short-time spectral amplitude (STSA) of the contaminated acoustic signal. This kind of STSA manipulation schemes is widely used for its computational advantage. Among others, MMSE (Minimum Mean Square Error) STSA proposed by Ephraim and Malah (reference [1]) is the most popular STSA based algorithm. FIG. 1 shows an acoustic signal enhancement apparatus 100 according to the MMSE STSA algorithm proposed by Ephraim and Malah. The acoustic signal enhancement apparatus 100 comprises a frame decomposition & windowing unit 110, a Fourier transform unit 120, a noise estimation unit 130, an a posteriori SNR (signal-to-noise ratio) estimation unit 140, an a priori SNR estimation unit 150, a spectral gain calculation unit 160, a multiplication unit 170, an inverse Fourier transform unit 180, and a frame synthesis unit 190.

Assume that a clean speech s(t) is contaminated by a background noise d(t), a noisy speech x(t) received by the acoustic signal enhancement apparatus 100 is given by $$x(t)=s(t)+d(t), \tag{1}$$

where t represents a time index. The frame decomposition & windowing unit 110 segments the noisy speech x(t) into frames of M samples. The frame decomposition & windowing unit 110 further applies an analysis window h(t) of a size 2M with a 50% overlap on the segmented noisy speech $x_n(t)$ in frame n so as to generate a windowed frame $x_n'(t)$ with 2M samples as follows $$x_n'(t) = \begin{cases} h(t)x_{n-1}(t) & 1 \le t \le M \\ h(t)x_n(t-M) & M < t \le 2M \end{cases} \tag{2}$$

The Fourier transform unit 120 applies a spectral transformation applies a discrete Fourier transform on the windowed frame $x_n'(t)$ to generate $X_n(k)$, which can be thought of as a spectral representation of $x_n'(t)$. Herein n and k refer to the analyzed frame and the frequency bin index respectively. In this example, the acoustic signal enhancement apparatus 100 applies noise suppression to only the spectral amplitude amp $[X_n(k)]$ of the noisy speech. The phase pha$[X_n(k)]$ of the noisy speech is directly used for the enhanced speech without being altered since the phase is trivial for speech quality and speech intelligibility. Herein the term amp[ . . . ] stands for an amplitude operator and the term pha[ . . . ] stands for a phase operator.

The noise estimation unit 130 estimates a noise spectrum $\lambda_n(k)$ for each of the spectral representation $X_n(k)$. There are many algorithms that can be applied by the noise estimation unit 130 to estimate the noise spectrum $\lambda_n(k)$. For example, the noise estimation unit 130 can obtain the noise spectrum $\lambda_n(k)$ by averaging the power spectrum of the noisy speech while only noise is included in the noisy speech. Reference [3] teaches another method for the noise estimation unit 130 to obtain the noise spectrum $\lambda_n(k)$.

Theoretically, the a posteriori SNR $\gamma_n(k)$ and the a priori SNR $\xi_n(k)$ are calculated by $$\Upsilon_n(k) = \text{amp}[X_n(k)]^2 / \text{E}\{\text{amp}[D_n(k)]^2\} \tag{3}$$

$$\xi_n(k) = \text{amp}[S_n(k)]^2 / \text{E}\{\text{amp}[D_n(k)]^2\} \tag{4}$$

where $D_n(k)$ and $S_n(k)$ are the discrete Fourier transform of d(t) and s(t) respectively. E{ . . . } stands for an expectation operator. Since $E\{\text{amp}[D_n(k)]^2\}$ is not available, the estimated noise spectrum $\lambda_n(k)$ will be utilized to approximate $E\{\text{amp}[D_n(k)]^2\}$. Therefore, the a posteriori SNR estimation unit 140 can approximate the a posteriori SNR $\gamma_n(k)$ by $\gamma_n'(k)$ as $$\gamma_n'(k)=\text{amp}[X_n(k)]^2/\lambda_n(k) \tag{5}$$

Having $\gamma_n'(k)$ for the current frame and $\gamma_{n-1}'(k)$ for the previously frame, the a priori SNR estimation unit 150 approximates the a priori SNR $\xi_n(k)$ by $\xi_n'(k)$ as $$\xi_n'(k)=\alpha\gamma_{n-1}'(k)G_{n-1}(k)^2+(1-\alpha)P[\gamma_n'(k)-1] \tag{6}$$

where $\alpha$ is a forgetting factor satisfying $0<\alpha<1$, P[ . . . ] is a rectifying function, and $G_{n-1}(k)$ is the spectral gain determined for the previously frame.

With already determined $\gamma_n'(k)$ and $\xi_n'(k)$, the spectral gain calculation unit 160 can obtain the spectral gain for the current frame by $$G_n(k)=\{\xi_n'(k)+\text{sqrt}[\xi_n'(k)^2+2(1+\xi_n'(k))(\xi_n'(k)/\gamma_n'(k))]\}/[2(1+\xi_n'(k))] \tag{7}$$

where sqrt[ . . . ] is a square root operator.

Next, the multiplication unit 170 multiplies the original spectral amplitude amp$[X_n(k)]$ by the spectral gain $G_n(k)$ to get the enhanced spectral amplitude $G_n(k)$amp$[X_n(k)]$. The enhanced spectral representation $Y_n(k)$ of the frame $x_n'(t)$ is constructed with enhanced spectral amplitude $G_n(k)amp[X_n(k)]$ and the original phase $pha[X_n(t)]$ as:

$$Y_n(k) = \text{amp}[Y_n(k)] \times \exp\{j \times pha[Y_n(k)]\} = G_n(k) \times amp[X_n(k)] \times \exp\{j[pha[X_n(k)]\} \quad (8)$$

where j=sqrt(−1). Then, the inverse Fourier transform unit 180 applies a discrete inverse Fourier transform on the enhanced spectral representation $Y_n(k)$ to get $y_n'(t)$. Finally, the frame synthesis unit 190 obtains the enhanced speech $y_n(t)$ by performing an overlap-add processing as follows $$y_n(t)=y_{n-1}'(t+M)+y_n'(t), 1<=t<=M \quad (9)$$

The acoustic signal enhancement apparatus 100 works fine only when the SNR of the noisy speech x(t) is sufficiently good. However, when the SNR of the noisy speech x(t) is poor, the acoustic signal enhancement apparatus 100 will overly suppress the actual speech information included in the noisy speech x(t). Musical noise that deteriorates the quality of the enhanced speech $y_n(t)$ will probably be generate as a side effect. In other words, the performance of the acoustic signal enhancement apparatus 100 of the related art is not sufficiently good for a wide range of SNR.

SUMMARY OF THE INVENTION

The embodiments disclose an acoustic signal enhancement method. The acoustic signal enhancement method comprises the steps of applying a spectral transformation on a frame derived from an input acoustic signal to generate a spectral representation of the frame, estimating an a posteriori signal-to-noise ratio (SNR) and an a priori SNR of the frame, determining an a priori SNR limit for the frame, limiting the a priori SNR with the a priori SNR limit to generate a final a priori SNR for the frame, determining a spectral gain for the frame according to the a posteriori SNR and the final a priori SNR, and applying the spectral gain on the spectral representation of the frame so as to generate an enhanced spectral representation of the frame. One of the characteristics of the acoustic signal enhancement method is that the a priori SNR limit is a function of frequency.

The embodiments disclose an acoustic signal enhancement method. The acoustic signal enhancement method comprises the steps of applying a spectral transformation on a frame derived from an input acoustic signal to generate a spectral representation of the frame, estimating an a posteriori signal-to-noise ratio (SNR) and an a priori SNR of the frame, determining a spectral gain for the frame according to the a posteriori SNR and the a priori SNR, determining a spectral gain limit for the frame, limiting the spectral gain with the spectral gain limit to generate a final spectral gain for the frame, and applying the final spectral gain on the spectral representation of the frame to generate an enhanced spectral representation of the frame. One of the characteristics of the acoustic signal enhancement method is that the a priori SNR limit is a function of frequency.

These and other objectives of the present invention will no doubt become obvious to those of ordinary skill in the art after reading the following detailed description of the preferred embodiment that is illustrated in the various figures and drawings.

DETAILED DESCRIPTION

Figure 2:
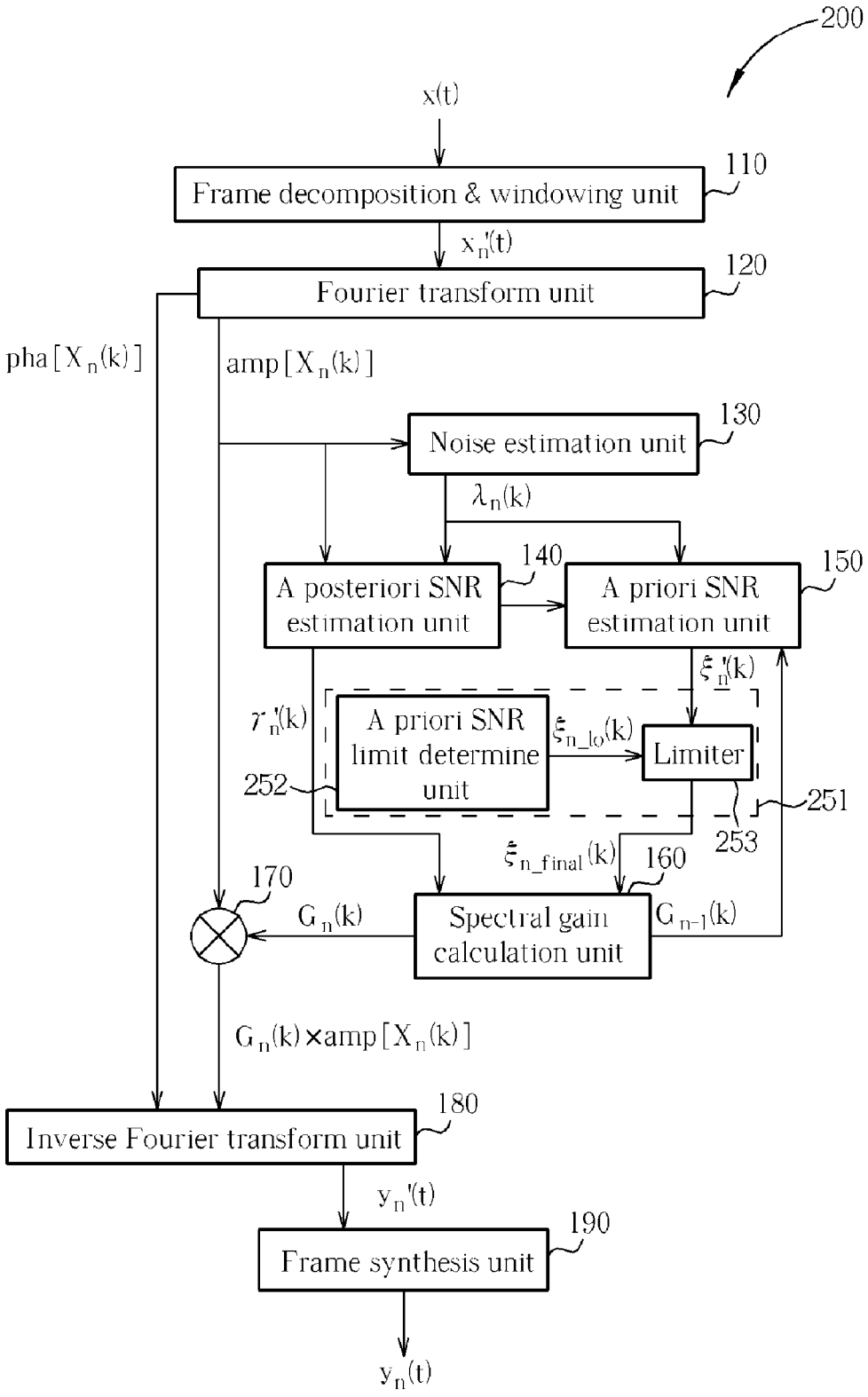
FIG. 2 shows an acoustic signal enhancement apparatus according to a first embodiment.

FIG. 2 shows an acoustic signal enhancement apparatus 200 according to a first embodiment. Herein similar reference numerals are used for those components of the acoustic signal enhancement apparatus 200 that serve the same function as the corresponding components of the acoustic signal enhancement apparatus 100 of the related art. These functions have been previously described and will not be again elaborated on here. One of the major differences between the acoustic signal enhancement apparatus 200 and the acoustic signal enhancement apparatus 100 is that to prevent the actual speech information included in the noisy speech x(t) from being suppressed too much, the acoustic signal enhancement apparatus 200 of the first embodiment further comprises a perceptual limit module 251. The perceptual limit module 251 utilizes an a priori SNR limit $\xi_{n_lo}(k)$ to restrict the a priori SNR $\xi_n'(k)$ generated by the a priori SNR estimation unit 150. Another different point is that the spectral gain calculation unit 160 calculates the spectral gain $G_n(k)$ for the current frame according to the final a priori SNR $\xi_{n_final}(k)$ generated by the perceptual limit module 251 rather than according to the a priori SNR $\xi_n'(k)$.

The perceptual limit module 251 comprises an a priori SNR limit determine unit 252 and a limiter 253. The a priori SNR limit determine unit 252 calculates an a priori SNR limit $\xi_{n_lo}(k)$, for k=1, $k_{max}$. The limiter 253 then utilizes the a priori SNR limit $\xi_{n_lo}(k)$ as a low limit to restrict the a priori SNR so as to generate the final a priori SNR $\xi_{n_final}(k)$ as follows $$\xi_{n_final}(k)=\max[\xi_{n_lo}(k),\xi_n'(k)], k=1, \ldots, k_{max} \quad (10)$$

There are many feasible ways that the a priori SNR limit determine unit 252 can utilize to calculates the a priori SNR limit $\xi_{n_lo}(k)$. Three of the feasible ways are illustrated herein after.

In a first feasible way for the a priori SNR limit determine unit 252 to calculate the a priori SNR limit $\xi_{n_lo}(k)$, the concept of auditory masking threshold (AMT) is utilized. Briefly speaking, the AMT defines a spectral amplitude threshold below which noise components are masked in the presence of the speech signal. Detailed derivation of the AMT can be found in many papers. For example, to derive the AMT, first a critical band analysis is performed to obtain energies in speech critical bands as follows $$B(i) = \sum_{k=b_low(i)}^{b_high(i)} |X_n(k)|^2, \quad i = 1, \ldots, i_{max} \quad (11)$$

where b_high(i) and b_low(i) are the upper and lower limits of the $i^{th}$ critical band respectively. Next, a spreading function S(i) is utilized to generate a spread critical band spectrum C(i) as follows $$C(i)=S(i)*B(i) \quad (12)$$

Then, the tonelike/noiselike nature of the spectrum should be determined. For example, a spectral flatness measure (SFM) can be utilized to determine the tonelike/noiselike nature of the spectrum as follows $$SFM_{dB}=10\log_{10}(G_m/A_m) \tag{13}$$

$$\alpha_T=\min[(SFM_{dB}/SFM_{dB_max}),1] \tag{14}$$

where $G_m$ stands for the geometric mean of C(i), and $A_m$ stands for the arithmetic mean of C(i). $SFM_{dB_max}$ equals −60 dB for completely tonelike signal. When the spectrum is completely noiselike, $SFM_{dB}$ equals 0 dB and $\alpha_T$ equals 0. An offset O(i) for the $i^{th}$ critical band is then determined according to $\alpha_T$. For example, O(i) is given by $$O(i)=\alpha_T(14.5+(1+\alpha_T)5.5 \tag{15}$$

Now the auditory masking threshold for a speech frame can be given by $$T(i)=10^{10\log_{10}[C(i)]-[O(i)/10]} \tag{16}$$

The auditory masking threshold T(i) still have to be transferred back to the bark domain through renormalization as follows $$T'(i)=[B(i)/C(i)]\times T(i) \tag{17}$$

Incorporating the renormalized AMT with the absolute threshold of hearing (ATH), the final AMT is generated as follows $$T_J(m)=\max\{T'[z(f_s(m/M))],T_q(f_s(m/M)) \tag{18}$$

where $f_s(m/M)$ is the central frequency of the $m^{th}$ Fourier band and $T_q(\ldots)$ is the absolute threshold of hearing. Putting the acquired AMT value onto the corresponding Fourier spectrum $T_J'(k)$, the a priori SNR limit $\xi_{n_lo}(k)$ can finally be obtained through the following equations $$w_n(k)=\max\{0,\lambda_n(k)-T_J'(k)/T_{Jmax}\},k=1,\ldots,k_{max} \tag{19}$$

$$\xi_{n_lo}(k)=t_1+t_2\times\exp[1-w_n(k)],k=1,\ldots,k_{max} \tag{20}$$

where $t_1$ and $t_2$ are two constant values that can be determined beforehand. In equation (19), $T_J'(k)/T_{Jmax}$ can be thought of as a relative AMT of the frame, and $w_n(k)$ that equals either 0 or $\lambda_n(k)-T_J'(k)/T_{Jmax}$ can be thought of as a surplus noise spectrum of the frame.

In a second feasible way for the a priori SNR limit determine unit 252 to calculates the a priori SNR limit $\xi_{n_lo}(k)$, the similar AMT concept is applied. Briefly speaking, when the amplitude of a specific band of the speech signal become larger, the noise tolerance of the specific band also becomes better, and eliminating less noise can still generate acceptable speech quality. In addition, according to the estimated noise spectrum, more noise is eliminated on frequency band with relative large noise amplitude, while less noise is eliminated on frequency band with relative small noise amplitude.

A first function, which is a second order curve in this example, approximating a speech spectrum of the frame is given by $$v_n(k)=c-b(k-ind)^2,k=1,\ldots,k_{max} \tag{21}$$

where c, b, and ind are three unknowns. Apparently, c corresponds to the largest $v_n(k)$ and ind corresponds to the frequency with the largest $v_n(k)$. Hence, ind could be determined as the frequency within a fix searching range that corresponds to the largest a posteriori SNR $\gamma_n'(k)$, as follows $$ind=\max_ind[\gamma_n'(mid_bin:high_bin)]. \tag{22}$$

wherein mid_bin and high_bin constitutes two boundaries of the aforementioned searching range. And c can be determined as an average SNR of several frequency bands near ind, therefore c is given by $$c=\max\{1,\log[\mathrm{mean}(\gamma_n(ind-L:ind+L))]\} \tag{23}$$

where ind−L and ind+L define a frequency range for determining the aforementioned average SNR. Assume that $v_n(k)$ equals 0 when k equals 0, b can be determined by $$b=c/ind^2 \tag{24}$$

Next, according to the estimated noise spectrum $\lambda_n(k)$, a second function approximating a relative noise spectrum of the frame is given by $$w_n(k)=\min[t_3,\lambda_n(k)/\lambda_{n_max}], \tag{25}$$

Finally, the a priori SNR limit $\xi_{n_lo}(k)$ can be obtained through utilizing the following third function, which utilizes the outputs of the first and second function as its inputs, as follows $$\xi_{n_lo}(k)=t_5\times\exp[1-t_4w_n(k)]\times\exp[v_n(k)],k=1,\ldots,k_{max} \tag{26}$$

where $t_3$, $t_4$, and $t_5$ are three constant values that can be determined beforehand.

In a third feasible way, the a priori SNR limit determine unit 252 determines the a priori SNR limit $\xi_{n_lo}(k)$ by examining the characteristics of the frame $x_n'(t)$. For example, the a priori SNR limit determine unit 252 can categorize the frame $x_n'(t)$ into one of a plurality of speech classes by detecting the speech gender of the frame $x_n'(t)$ or by applying a voice activity detection (VAD) on the frame $x_n'(t)$. For each of the speech classes, the a priori SNR limit determine unit 252 has access to a predetermined a priori SNR limit $\xi_{n_lo}(k)$ corresponding to the speech class, as follows $$\xi_{n_lo}(k)=\begin{cases}\xi_{n_lo1}(k),\ \text{class 1}\\ \xi_{n_lo2}(k),\ \text{class 2},\quad k=1,\ldots,k_{max}\\ \ldots\end{cases} \tag{27}$$

Please note that in the embodiment shown in FIG. 2, the a priori SNR limit $\xi_{n_lo}(k)$ adaptively generated by the a priori SNR limit determine unit 252 is a function of frequency. In other words, the a priori SNR limit is a frequency dependent value rather than being a single value for all the frequency bands. This ensures that the noise that contaminates the noisy speech x(t) will be suppressed adaptively.

Figure 1:
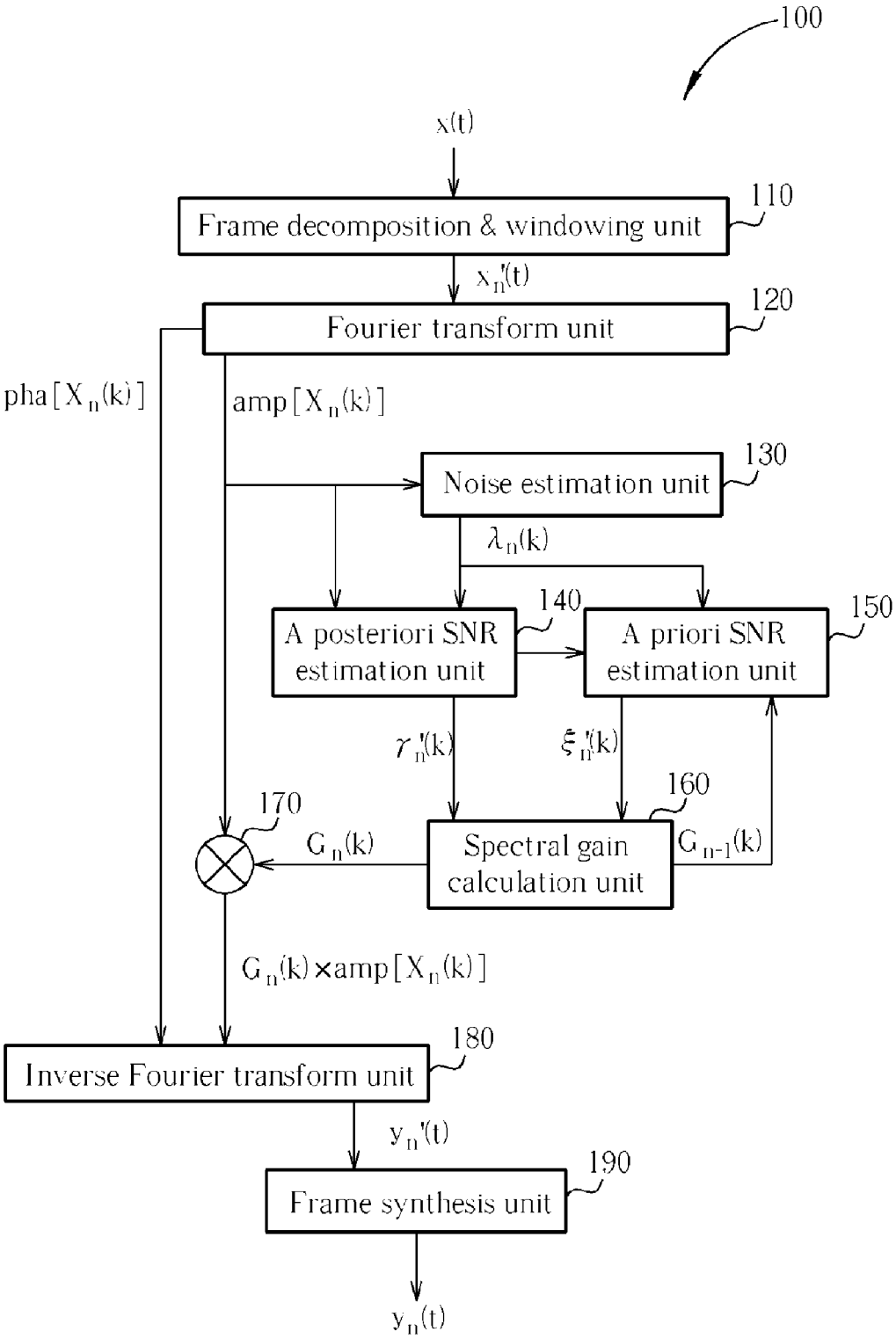
Fig. 1 Related Art
FIG. 1 shows an acoustic signal enhancement apparatus of the related art.
Figure 3:
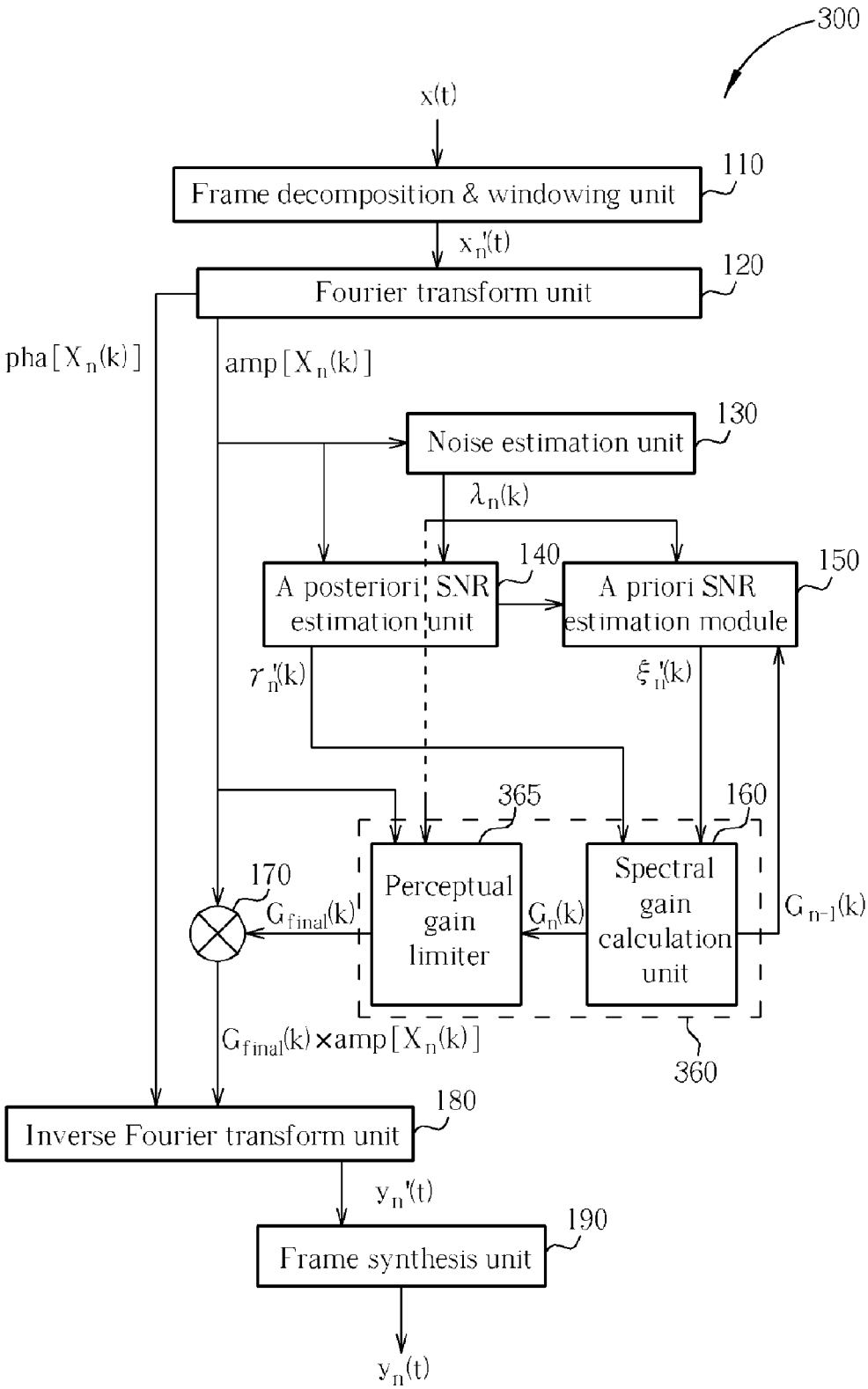
FIG. 3 shows an acoustic signal enhancement apparatus according to a second embodiment.

FIG. 3 shows an acoustic signal enhancement apparatus 300 according to a second embodiment. Herein similar reference numerals are used for those components of the acoustic signal enhancement apparatus 300 that serve the same function as the corresponding components of the acoustic signal enhancement apparatus 100 of the related art. These functions have been previously described and will not be again elaborated on here. One of the different points between the acoustic signal enhancement apparatus 300 and the acoustic signal enhancement apparatus 100 is that to prevent the actual speech information included in the noisy speech x(t) from being suppressed too much, the acoustic signal enhancement apparatus 300 of the second embodiment further comprises a perceptual gain limiter 365 for limiting the spectral gain $G_n(k)$ by utilizing a gain limit $G_{lim}(k)$. Please note that the gain limit $G_{lim}(k)$ utilized by the perceptual gain limiter 365 is a function of frequency. In other words, the gain limit is a frequency dependent value rather than being a single value for all the frequency bands. Besides, in one example the a priori SNR estimation module 350 includes only the a priori SNR estimation unit 150 shown in FIG. 1. In another example, the a priori SNR estimation module 350 includes both the a priori SNR estimation unit 150 and the perceptual limit module 251 shown in FIG. 2, and the final a priori SNR $\xi_{n_final}(k)$ generated by the perceptual limit module 251 serves as the a priori SNR (k) generated by the a priori SNR estimation module 350.

There are many feasible ways that the perceptual gain limiter 365 can utilize to calculates the gain limit $G_{lim}(k)$. In one of the feasible ways the concept of AMT is utilized. More specifically, the perceptual gain limiter 365 can first calculate the AMT with equations (11)~(18). Then the perceptual gain limiter 365 calculates the gain limit $G_{lim}(k)$ according to the AMT and the estimated noise spectrum $\lambda_n(k)$ of the considered frame as follows $$G_{lim}(k)=\text{sqrt}[T_J'(k)/\lambda_n(k)+zJ],k=1,\ldots,k_{max} \quad (28)$$

where z is an adjustable parameter. The final gain $G_{final}(k)$ that is sent to the multiplication unit 170 is given by $$G_{final}(k)=\max[G_{lim}(k),G_n(k)],k=1,\ldots,k_{max} \quad (29)$$

Using the frequency dependent gain limit $G_{lim}(k)$ to limit the spectral gain $G_n(k)$ prevents the final gain $G_{final}(k)$ from being set too small. This ensures that the actual speech information included in the noisy speech x(t) will not be suppressed too much.

Figure 4:
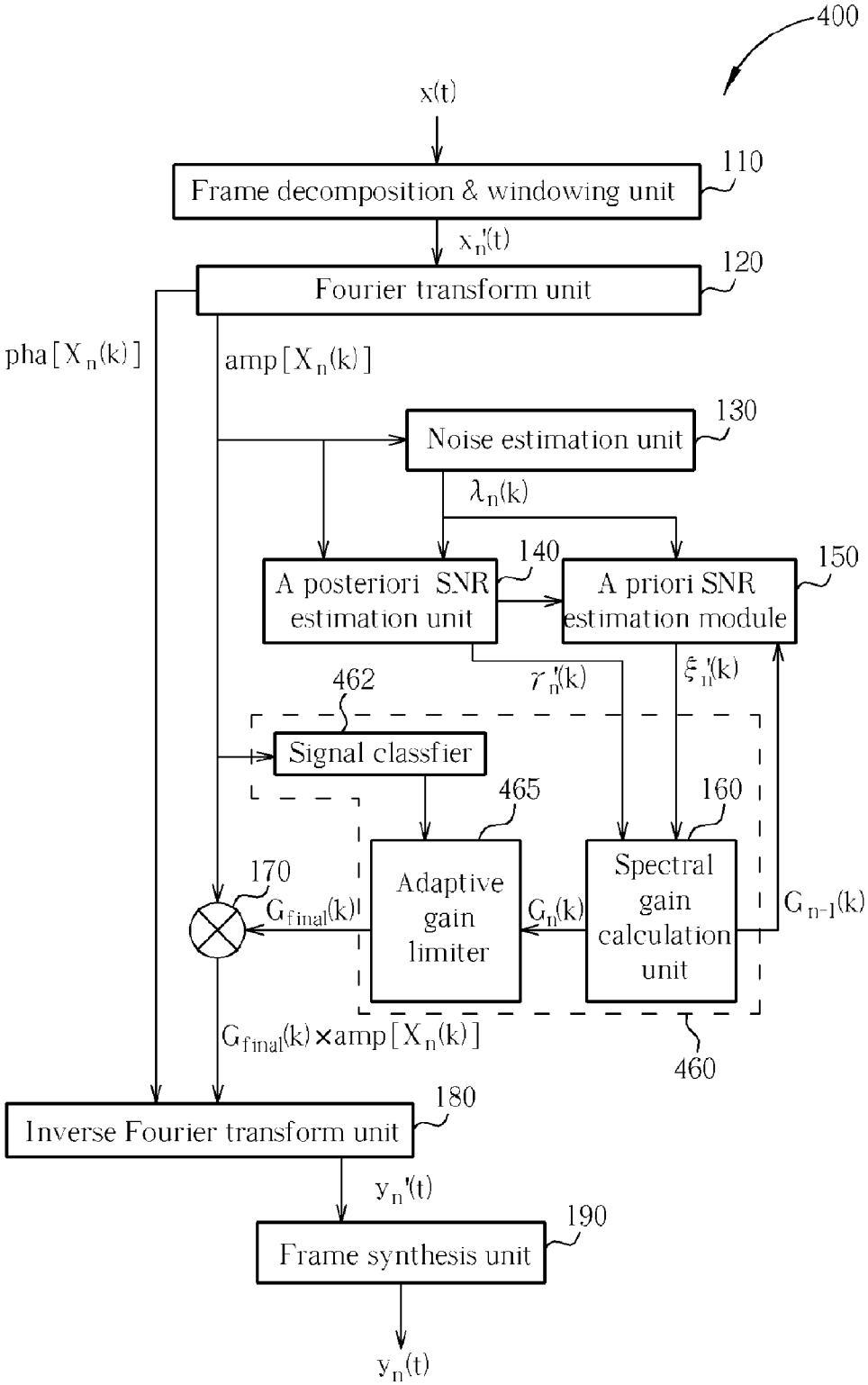
FIG. 4 shows an acoustic signal enhancement apparatus according to a third embodiment.

FIG. 4 shows an acoustic signal enhancement apparatus according to a third embodiment. Herein similar reference numerals are used for those components of the acoustic signal enhancement apparatus 400 that serve the same function as the corresponding components of the acoustic signal enhancement apparatus 100 of the related art. These functions have been previously described and will not be again elaborated on here. A different point between the acoustic signal enhancement apparatus 400 and the acoustic signal enhancement apparatus 100 is that to prevent the actual speech information included in the noisy speech x(t) from being suppressed too much, the acoustic signal enhancement apparatus 400 of the third embodiment further comprises a signal classifier 462 and an adaptive gain limiter 465. The signal classifier 462 categorizes the frame $x_n'(t)$ through examining the characteristics of the frame $x_n'(t)$. For example, the signal classifier 462 categorize the frame $x_n'(t)$ into one of a plurality of speech classes by detecting the speech gender of frame $x_n'(t)$ or by applying a voice activity detection (VAD) on the frame $x_n'(t)$. For each of the speech classes, the adaptive gain limiter 465 has access to a predetermined gain limit $G_{lim}(k)$ corresponding to the speech class, as follows $$G_{lim}(k)=\begin{cases} G_{lim1}(k),\ \text{class 1} \\ G_{lim2}(k),\ \text{class 2},\quad k=1,\ldots,k_{max} \\ \ldots \end{cases} \quad (30)$$

The adaptive gain limiter 465 then utilizes the gain limit $G_{limit}(k)$ as a lower limit to restrict the spectral gain $G_n(k)$ so as to generate a final gain $G_{final}(k)$ that will then be sent to the multiplication unit 170, as follows $$G_{final}(k)=\max[G_{lim}(k),G_n(k)],k=1,\ldots,k_{max} \quad (31)$$

Using the frequency dependent gain limit $G_{lim}(k)$ to limit the spectral gain $G_n(k)$ prevents the final gain $G_{final}(k)$ from being set too small. This ensures that the actual speech information included in the noisy speech x(t) will not be suppressed too much.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An acoustic signal enhancement method comprising the steps of:

applying a spectral transformation on a frame derived from an input acoustic signal to generate a spectral representation of the frame;

estimating an a posteriori signal-to-noise ratio (SNR) and an a priori SNR of the frame;

determining an a priori SNR limit for the frame;

limiting the a priori SNR with the a priori SNR limit to generate a final a priori SNR for the frame;

determining a spectral gain for the frame according to the a posteriori SNR and the final a priori SNR; and applying the spectral gain on the spectral representation of the frame so as to generate an enhanced spectral representation of the frame;

wherein the a priori SNR limit is a function of frequency.

2. The method of claim 1, wherein the step of determining the a priori SNR limit for the frame comprises:

estimating an auditory masking threshold (AMT) of the frame;

estimating a surplus noise spectrum of the frame according to the AMT; and determining the a priori SNR limit according to the surplus noise spectrum.

3. The method of claim 2, wherein the step of estimating the surplus noise spectrum of the frame according to the AMT comprises:

estimating a noise spectrum of the frame;

determining a relative AMT for the frame according to the AMT of the frame; and subtracting the relative AMT from the noise spectrum so as to estimate the surplus noise spectrum of the frame.

4. The method of claim 2, wherein the a priori SNR limit is negatively correlated with the surplus noise spectrum.

5. The method of claim 1, wherein the step of determining the a priori SNR limit for the frame comprises:

utilizing a first function to approximate a speech spectrum of the frame;

utilizing a second function to approximate a relative noise spectrum of the frame; and utilizing a third function to determine the a priori SNR limit for the frame, the inputs of the third function comprising the outputs of the first and second functions.

6. The method of claim 5, wherein the first function is a second order function of frequency.

7. The method of claim 5, wherein for the output of the third function is positively correlated with the output of the first function and negatively correlated with the output of the second function.

8. The method of claim 1, wherein the step of determining the a priori SNR limit for the frame comprises:

categorizing the frame; and determining the a priori SNR limit for the frame according to a categorization result of the frame.

9. The method of claim 8, wherein the step of categorizing the frame comprises:

applying a voice activity detection (VAD) on the frame so as to categorize the frame.

10. The method of claim 8, wherein the step of categorizing the frame comprises:

detecting a speech gender of the frame so as to categorize the frame.

11. The method of claim 1, wherein the step of determining the spectral gain for the frame according to the a posteriori SNR and the final a priori SNR comprises:

determining a preliminary spectral gain for the frame according to the a posteriori SNR and the final a priori SNR;

determining a spectral gain limit for the frame; and limiting the preliminary spectral gain with the spectral gain limit to generate the spectral gain for the frame;

wherein the spectral gain limit is a function of frequency.

12. The method of claim 11, wherein the step of determining the spectral gain limit for the frame comprises:

estimating an AMT of the frame;

estimating a noise spectrum of the frame; and determining the spectral gain limit according to the AMT and the noise spectrum.

13. The method of claim 12, wherein the spectral gain limit is positively correlated with the AMT and negatively correlated with the noise spectrum.

14. The method of claim 11, wherein the step of determining the spectral gain limit for the frame comprises:

categorizing the frame; and determining the spectral gain limit for the frame according to a categorization result of the frame.

15. The method of claim 14, wherein the step of categorizing the frame comprises:

applying a VAD on the frame so as to categorize the frame.

16. The method of claim 14, wherein the step of categorizing the frame comprises:

detecting a speech gender of the frame so as to categorize the frame.

17. An acoustic signal enhancement method comprising the steps of:

applying a spectral transformation on a frame derived from an input acoustic signal to generate a spectral representation of the frame;

estimating an a posteriori signal-to-noise ratio (SNR) and an a priori SNR of the frame;

determining a spectral gain for the frame according to the a posteriori SNR and the a priori SNR;

determining a spectral gain limit for the frame;

limiting the spectral gain with the spectral gain limit to generate a final spectral gain for the frame; and applying the final spectral gain on the spectral representation of the frame to generate an enhanced spectral representation of the frame;

wherein the spectral gain limit is a function of frequency.

18. The method of claim 17, wherein the step of determining the spectral gain limit for the frame comprises:

estimating an auditory masking threshold (AMT) of the frame;

estimating a noise spectrum of the frame; and determining the spectral gain limit according to the AMT and the noise spectrum.

19. The method of claim 18, wherein the spectral gain limit is positively correlated with the AMT and negatively correlated with the noise spectrum.

20. The method of claim 17, wherein the step of determining the spectral gain limit for the frame comprises:

categorizing the frame; and determining the spectral gain limit for the frame according to a categorization result of the frame.

21. The method of claim 20, wherein the step of categorizing the frame comprises:

applying a voice activity detection (VAD) on the frame so as to categorize the frame.

22. The method of claim 20, wherein the step of categorizing the frame comprises:

detecting a speech gender of the frame so as to categorize the frame.

23. The method of claim 17, wherein the step of estimating the a posteriori SNR and the a priori SNR of the frame comprises:

estimating a preliminary a priori SNR of the frame;

determining an a priori SNR limit for the frame; and limiting the preliminary a priori SNR with the a priori SNR limit to generate the a priori SNR for the frame;

wherein the a priori SNR limit is a function of frequency.

24. The method of claim 23, wherein the step of determining the a priori SNR limit for the frame comprises:

estimating an AMT of the frame;

estimating a surplus noise spectrum of the frame according to the AMT; and determining the a priori SNR limit according to the surplus noise spectrum.

25. The method of claim 24, wherein the step of estimating the surplus noise spectrum of the frame according to the AMT comprises:

estimating a noise spectrum of the frame;

determining a relative AMT for the frame according to the AMT of the frame; and subtracting the relative AMT from the noise spectrum so as to estimate the surplus noise spectrum of the frame.

26. The method of claim 24, wherein the a priori SNR limit is negatively correlated with the surplus noise spectrum.

27. The method of claim 23, wherein the step of determining the a priori SNR limit for the frame comprises:

utilizing a first function to approximate a speech spectrum of the frame;

utilizing a second function to approximate a relative noise spectrum of the frame; and utilizing a third function to determine the a priori SNR limit for the frame, the inputs of the third function comprising the outputs of the first and second functions.

28. The method of claim 27, wherein the first function is a second order function of frequency.

29. The method of claim 27, wherein for the output of the third function is positively correlated with the output of the first function and negatively correlated with the output of the second function.

30. The method of claim 23, wherein the step of determining the a priori SNR limit for the frame comprises:

categorizing the frame; and determining the a priori SNR limit for the frame according to a categorization result of the frame.

31. The method of claim 30, wherein the step of categorizing the frame comprises:

applying a VAD on the frame so as to categorize the frame.

32. The method of claim 30, wherein the step of categorizing the frame comprises:

detecting a speech gender of the frame so as to categorize the frame.

33. An acoustic signal enhancement apparatus comprising:

a Fourier transform unit for applying a spectral transformation on a frame derived from an input acoustic signal to generate a spectral representation of the frame;

a noise estimation unit coupled to the Fourier transform unit, for estimating a noise spectrum of the frame;

an a posteriori signal-to-noise ratio (SNR) estimation unit coupled to the Fourier transform unit and the noise estimation unit, for estimating an a posteriori SNR of the frame;

an a priori SNR estimation unit coupled to the noise estimation unit and the a posteriori SNR estimation unit, for estimating an a priori SNR of the frame;

an a priori SNR limit determine unit for determining an a priori SNR limit for the frame;

a limiter coupled to the a priori SNR estimation unit and the a priori SNR limit determine unit, for limiting the a priori SNR with the a priori SNR limit to generate a final a priori SNR for the frame;

a spectral gain calculation module coupled to the a posteriori SNR estimation unit, the a priori SNR estimation unit, and the limiter, for determining a spectral gain for the frame according to the a posteriori SNR and the final a priori SNR; and a multiplication unit coupled to the Fourier transform unit and the spectral gain calculation module, for applying the spectral gain on the spectral representation of the frame so as to generate an enhanced spectral representation of the frame;

wherein the a priori SNR limit is a function of frequency.

34. The apparatus of claim 33, wherein the spectral gain calculation module comprises:

a spectral gain calculation unit coupled to the a posteriori SNR estimation unit and the limiter, for determining a preliminary spectral gain for the frame according to the a posteriori SNR and the final a priori SNR; and a perceptual gain limiter coupled to the spectral gain calculation unit, the Fourier transform unit, the noise estimation unit, and the multiplication unit, for determining a spectral gain limit for the frame according to the spectral representation and the noise spectrum of the frame, and for limiting the preliminary spectral gain with the spectral gain limit to generate the spectral gain for the frame;

wherein the spectral gain limit is a function of frequency.

35. The apparatus of claim 33, wherein the spectral gain calculation module comprises:

a spectral gain calculation unit coupled to the a posteriori SNR estimation unit and the limiter, for determining a preliminary spectral gain for the frame according to the a posteriori SNR and the final a priori SNR;

a signal classifier coupled to the Fourier transform unit, for categorizing the frame; and an adaptive gain limiter coupled to the spectral gain calculation unit, the signal classifier, and the multiplication unit, for determining a spectral gain limit for the frame according to a categorization result of the frame, and for limiting the preliminary spectral gain with the spectral gain limit to generate the spectral gain for the frame;

wherein the spectral gain limit is a function of frequency.

36. An acoustic signal enhancement apparatus comprising:

a Fourier transform unit for applying a spectral transformation on a frame derived from an input acoustic signal to generate a spectral representation of the frame;

a noise estimation unit coupled to the Fourier transform unit, for estimating a noise spectrum of the frame;

an a posteriori signal-to-noise ratio (SNR) estimation unit coupled to the Fourier transform unit and the noise estimation unit, for estimating an a posteriori SNR of the frame;

an a priori SNR estimation module coupled to the noise estimation unit and the a posteriori SNR estimation unit, for estimating an a priori SNR of the frame;

a spectral gain calculation unit coupled to the a posteriori SNR estimation unit and the a priori SNR estimation module, for determining a preliminary spectral gain for the frame according to the a posteriori SNR and the a priori SNR;

a perceptual gain limiter coupled to the Fourier transform unit, the spectral gain calculation unit, and the noise estimation unit, for determining a spectral gain limit for the frame according to the spectral representation and the noise spectrum of the frame, and for limiting the preliminary spectral gain with the spectral gain limit to generate a spectral gain for the frame; and a multiplication unit coupled to the Fourier transform unit and the perceptual gain limiter for applying the spectral gain on the spectral representation of the frame so as to generate an enhanced spectral representation of the frame;

wherein the spectral gain limit is a function of frequency.

37. The apparatus of claim 36, wherein the a priori SNR estimation module comprises:

an a priori SNR estimation unit coupled to the noise estimation unit and the a posteriori SNR estimation unit, for estimating a preliminary a priori SNR of the frame;

an a priori SNR limit determine unit for determining an a priori SNR limit for the frame; and a limiter coupled to the a priori SNR estimation unit, the a priori SNR limit determine unit, and the spectral gain calculation unit, for limiting the preliminary a priori SNR with the a priori SNR limit to generate the a priori SNR for the frame;

wherein the a priori SNR limit is a function of frequency.

38. An acoustic signal enhancement apparatus comprising:

a Fourier transform unit for applying a spectral transformation on a frame derived from an input acoustic signal to generate a spectral representation of the frame;

a noise estimation unit coupled to the Fourier transform unit, for estimating a noise spectrum of the frame;

an a posteriori signal-to-noise ratio (SNR) estimation unit coupled to the Fourier transform unit and the noise estimation unit, for estimating an a posteriori SNR of the frame;

an a priori SNR estimation module coupled to the noise estimation unit and the a posteriori SNR estimation unit, for estimating an a priori SNR of the frame;

a spectral gain calculation unit coupled to the a posteriori SNR estimation unit and the a priori SNR estimation module, for determining a preliminary spectral gain for the frame according to the a posteriori SNR and the a priori SNR; and a signal classifier coupled to the Fourier transform unit, for categorizing the frame; and an adaptive gain limiter coupled to the spectral gain calculation unit and the signal classifier, for determining a spectral gain limit for the frame according to a categorization result of the frame, and for limiting the preliminary spectral gain with the spectral gain limit to generate a spectral gain for the frame; and a multiplication unit coupled to the adaptive gain limiter and the Fourier transform unit, for applying the spectral gain on the spectral representation of the frame so as to generate an enhanced spectral representation of the frame;

wherein the spectral gain limit is a function of frequency.

39. The apparatus of claim 38, wherein the a priori SNR estimation module comprises:

an a priori SNR estimation unit coupled to the noise estimation unit and the a posteriori SNR estimation unit, for estimating a preliminary a priori SNR of the frame;

an a priori SNR limit determine unit for determining an a priori SNR limit for the frame; and a limiter coupled to the a priori SNR estimation unit, the a priori SNR limit determine unit, and the spectral gain calculation unit, for limiting the preliminary a priori SNR with the a priori SNR limit to generate the a priori SNR for the frame;

wherein the a priori SNR limit is a function of frequency.

* * * * *